United States Patent [19]

Thomas

[11] 4,269,149

[45] May 26, 1981

[54] PASSIVE RESTRAINER FOR SMALL ANIMALS

[76] Inventor: Roy W. Thomas, 1045 "C" Ave., National City, Calif. 92050

[21] Appl. No.: 39,210

[22] Filed: May 15, 1979

[51] Int. Cl.[3] ..... A61D 3/00

[52] U.S. Cl. ..... 119/103; 119/99

[58] Field of Search ..... 119/103, 98, 99, 96, 119/156, 158, 159, 19, 160

[56] References Cited

U.S. PATENT DOCUMENTS

| | | | |
|---|---|---|---|
| 125,120 | 4/1872 | Cox | 119/99 |
| 922,667 | 5/1909 | Cardwell | 119/98 |
| 1,879,915 | 9/1932 | Smoot | 119/159 |
| 2,438,322 | 3/1948 | McDonough | 119/99 |
| 2,987,042 | 6/1961 | Rothberg | 119/103 |
| 3,023,734 | 3/1962 | Schaub | 119/103 |
| 3,428,030 | 2/1969 | Updegraff | 119/96 |
| 3,941,092 | 3/1976 | Winters | 119/160 |
| 4,120,266 | 10/1978 | Oloff et al. | 119/103 |

FOREIGN PATENT DOCUMENTS

| | | | |
|---|---|---|---|
| 471751 | 11/1914 | France | 119/103 |
| 113788 | 4/1945 | Sweden | 119/103 |

*Primary Examiner*—Jay N. Eskovitz
*Attorney, Agent, or Firm*—Robert Brown, Jr.

[57] ABSTRACT

A passive restraining apparatus for use in the administration to small animals of anaesthetics, intravenous fluids, and the like consisting of a housing for loosely confining the animal's body. The housing is provided with a front wall which has (1) an upper opening therein for releasably holding the animal's neck in substantially immobilized position while its head projects forwardly from the wall, and (2) at least one lower opening through which the animal's forelegs are adapted to project forwardly of the wall, the wrist portions of the forelegs being releasably held in immobilized positions by anchoring devices. A shield or platform vertically supports the projecting head for relatively free sidewise movement about the immobilized neck and in proximate spaced relation above the forelegs, thereby preventing access by the animal's head to its forelegs and providing a safety zone in which attendants may examine and treat the forelegs.

2 Claims, 8 Drawing Figures

PASSIVE RESTRAINER FOR SMALL ANIMALS

This invention relates to apparatus for immobilizing small animals while subjecting them to examination and/or treatment by veterinarians and qualified personnel. The apparatus has been employed very successfully for anaesthetic and intravenous fluid administration, for skin and urine sample collections, and for general use where effective control of the animal's mobility is necessary.

Administering fluids and electrolytes to small animals is a time consuming and technically difficult task. The most effective method is by the intravenous route; however, such a procedure requires close supervision of trained individuals because the animals receiving the fluids often react frantically and shift the positions of their bodies and limbs. Moreover, the animals have a strong tendency to bite into or remove the intravenous catheter equipment and fluid administration tubes, thereby slowing or stopping the fluid drip. Such conditions obviously expose the attendants to a high risk of physical injury.

Heretofore, prior art devices have been provided for restraining small animals during examination and treatment, such as disclosed in U.S. Pat. Nos. 1,956,499, 2,498,051 and 3,187,721, each of which employs excessive restraint by immobilizing not only the neck, but by unnecessarily immobilizing and masking the head as well. Applicant's concept is based upon observations that when a sick or weak animal is placed in a physically restrictive space, its struggling is minimal when only the neck and foreleg are immobilized, leaving the head exposed with enough freedom of movement to permit observation of nearby activity. When confined in this manner, the animal tolerates the neck and foreleg restraint, whereas, additional head restraint serves to diminish the beneficial effect of the former.

It is therefore an object of this invention to provide a passive restraining device which will obviate the above-discussed shortcomings of prior art devices.

It is another object of this invention to provide a pillory-type apparatus of the class described adapted to immobilize the forelegs of an animal in positions for examination and intravenous fluid administration while the neck of the animal is immobilized, but leaving its head freedom of movement except downwardly toward its immobilized forelegs.

It is a further object of invention to provide a restraining device composed of a housing for confining an animal's body while permitting its head and forelegs to project forwardly beyond the front wall thereof, said wall having a rearwardly inclined upper panel with a neck-restraining opening therein which has its axis extending forwardly and upwardly substantially at the same angle as that of the normal inclination of the necks of animals thereby causing the opening to conform to the neck and also to cause its head to normally assume a higher and more remote position relative to its immobilized forelegs.

It is yet another object of this invention to provide a passive restrainer for small animals which is simple in construction, relatively inexpensive to manufacture and maintain, and highly efficient in operation.

Some of the objects of invention having been stated, other objects will appear as the description proceeds when taken in connection with the accompanying drawings, in which, FIG. 1 is a plan view of my improved restraining device, showing the lid thereof in partially open position, and the upper right-hand corner of the Figure in section;

Figure 5:
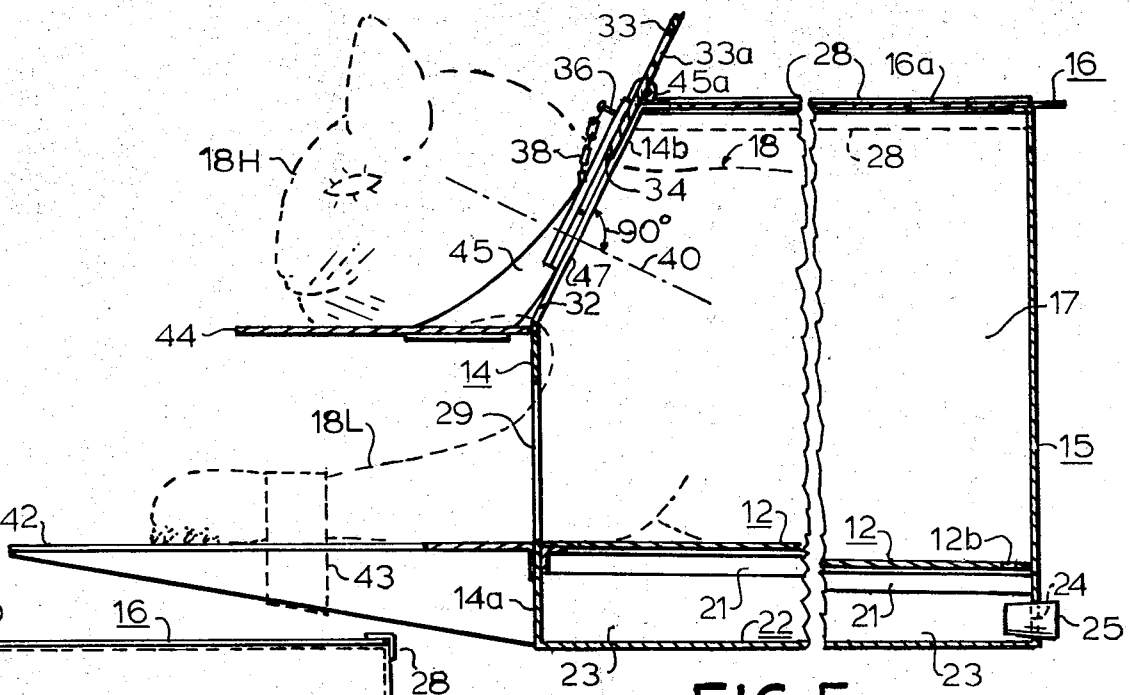
FIG. 5 is a sectional detail view taken along line 5—5 in FIG. 1, but with the intermediate portion of the device broken away.

Referring more particularly to the drawings, the numeral 10 denotes broadly the housing of the passive restrainer which comprises: opposite side walls 11, 11, a bottom wall 12, a front end wall 14, a back end wall 15, and a cover or lid 16, which members are assembled to provide a compartment 17 for loosely confining the body of animal 18, shown in dotted lines (FIG. 5).

Figure 6:
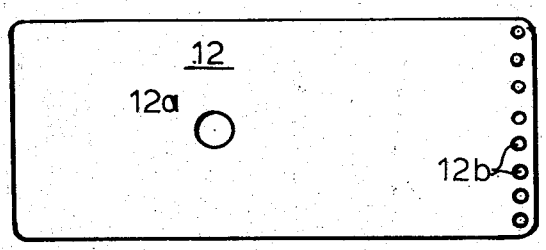
FIG. 6 is a detail view of the removable bottom of the device.

The proximate inner faces of side walls 11, 11 have angle irons suitably secured thereto for removably supporting the bottom wall 12, said irons and bottom wall being rearwardly and downwardly inclined to cause urine and other fluids of compartment 17 to flow rearwardly toward rear wall 15. In order to facilitate removal of bottom 12 from the housing for cleansing purposes, a finger opening **12*a* is provided (FIG. 6**).

Figure 4:
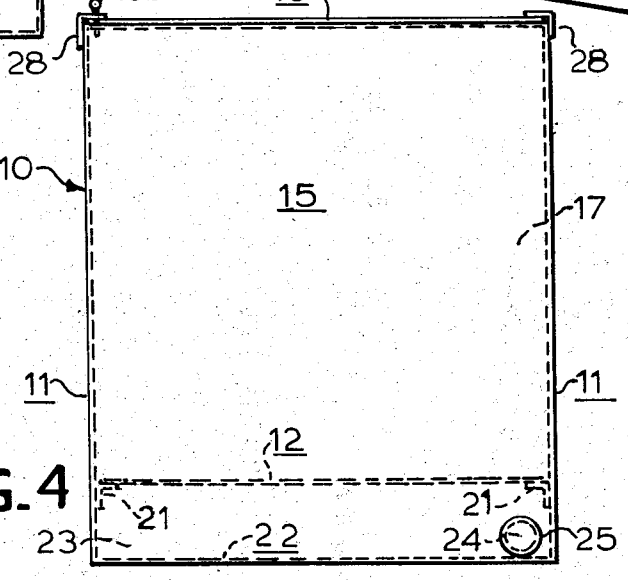
FIG. 4 is an elevational view, looking at the right-hand end of FIGS. 1 and 2.

Disposed below and in spaced relation to bottom wall 12 is a second bottom wall 22 which cooperates with the lower marginal edge portions of said front, rear and side walls to provide a liquid-tight compartment 23. It will be observed in in FIGS. 5 and 6 that the removable bottom wall 12 also has a row of openings **12*b* which permits the liquid and urine collecting at the lower right-hand end of compartment 17 to drain into liquid-tight compartment 23 therebelow. For the purpose of urine sampling, an access opening 24 is provided in rear wall 15, which opening is normally closed by a stopper or closure member 25 (FIGS. 4 and 5**).

The cover or lid 16 of compartment 17 is detachably and slidably mounted upon the upper edges of side walls 11,11 by any suitable means such as angle irons 28, 28. By sliding the lid rearwardly, the upper side of the compartment is opened to permit an animal to be deposited or removed. Lid 16 has a finger opening **16*a* to facilitate manipulation. After the animal has been suitably restrained or immobilized, as described later, lid 16** may be slid to open position, thereby exposing the dorsum of the patient to safely administer vaccinations and/or intra-muscular injections.

Figures 1, 2, 2A:
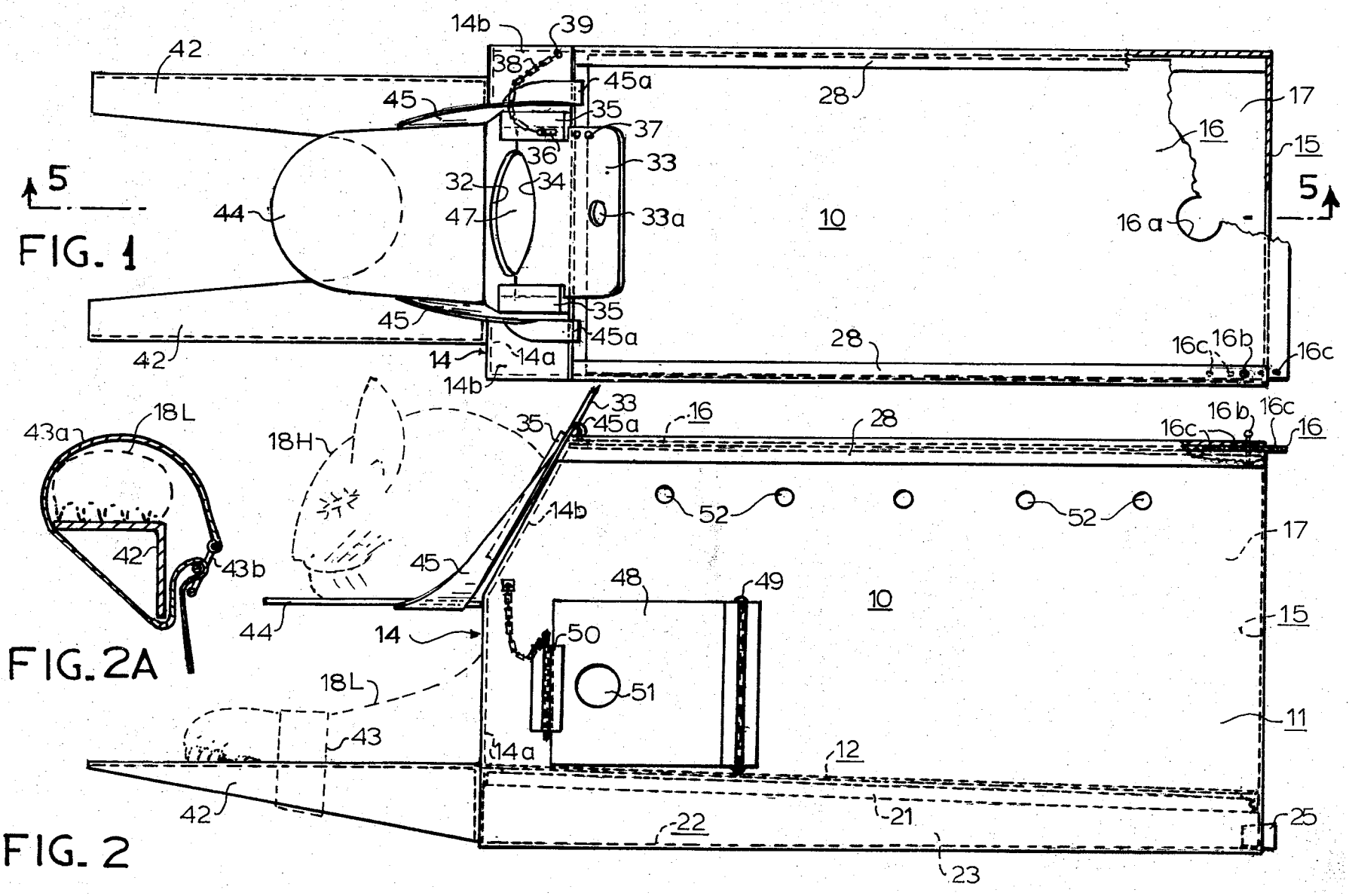
FIG. 2A is a sectional detail view showing a slightly modified form of anchor attachment for the animal's forelegs.
Figure 3:
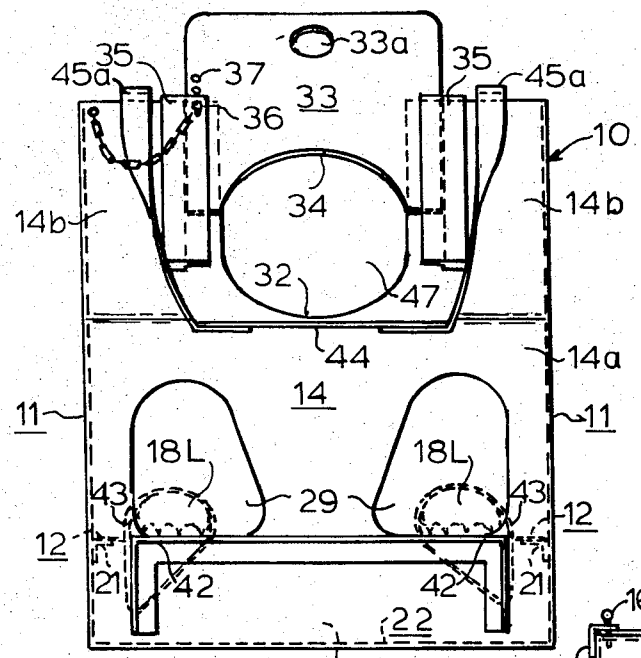
FIG. 3 is an elevational view, looking at the left-hand end of FIGS. 1 and 2.
Figure 7:
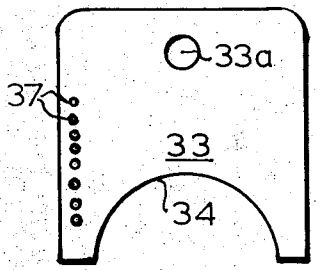
FIG. 7 is a detail view of the slidable gate or neck-plate 33 of the device.

Cover 16 may be releasably secured in selected fixed positions on housing 10 (either partially opened as shown in FIGS. 2 and 3, or completely closed) by any suitable means such as pin **16*b* adapted to penetrate an opening in angle iron 28 and one of the spaced openings 16*c*** in the cover.

The front wall 14 of housing 10 comprises a vertically disposed lower panel **14*a* having laterally spaced openings 29, 29 therein through which the forelegs 18L, 18L of animal 18 are adapted to project forwardly beyond the front wall. The wall 14 also comprises an upper rearwardly inclined panel 14*b* having an opening or edge notch 32 through which the animal's head 18H may project (FIG. 3), the concave periphery of the notch adapted to conform the lower part of the neck when the head 18H projects forwardly as shown in FIG. 5**.

In order to immobilize the animal's neck, a gate or plate 33 is provided with a concave edge notch 34 which is conformable to the upper portion of its neck, said plate being slidably mounted in guideways 35, 35 mounted on the face of the rearwardly inclined front panel **14*b* (FIG. 3). Plate 33 has a finger opening 33*a* therein which is used when adjusting the edge notch 34 to the proper height relative to the neck, at which time, the plate is secured in fixed position by any suitable means such as a pin 36 penetrating a hole in one of the guideways 35 and a coinciding hole 37 in the plate (FIGS. 1, 3, 5 and 7). The pin is attached to one end of a chain or cord 38, the other end of the latter being attached to panel 14*b* as at 39**.

It may be observed in FIG. 5 that the axis 40 of the neck opening 47 defined by lower and upper notches 32 and 34 is disposed at right angles to both the front panel and the gate plate 33, and further, that the axis extends forwardly and upwardly substantially in coaxial alinement with the normal axis of the animal's neck, thereby conforming opening 47 to the neck when in a natural posture while utilizing the minimum restraint necessary for immobilization of the neck. At the same time, the animal's head 18H is permitted limited sidewise movement but barred from movement downwardly toward its immobilized forelegs for reasons discussed more fully hereinafter.

A pair of anchor arms 42, 42 is cantilevered forwardly from front vertical panel **14*a* and adapted to support the projecting forelegs 18L, 18L of confined animal 18. Each anchor arm includes an attachment such as tape 43 for binding the associated foreleg in substantially immobilized position (FIGS. 2 and 5), or if desired, a strap 43*a* with a slip buckle 43*b* such as shown in FIG. 2A** may be employed as an anchor attachment.

It will be observed in FIGS. 1, 2, 2A, 3 and 5 that the openings 29, 29, through which the forearms of forelegs 18L, 18L project, are each larger than the cross-sectional area of the forearm therein. Also, the wrists of the forearms are each anchored to the outer end of one of the elongated forwardly projecting members 42 cantilevered from the front wall, said members being laterally spaced apart so that the cephalic veins in the forearms will be more accessible for intravenous administration, especially when the restrainer is positioned upon a table with with the cantilevered members extending beyond the edge of the table. Thus, the animal's forelegs are subjected to minimum restraint consistent with essential safety precautions.

As previously mentioned, it is desirable to permit limited lateral movement of the animal's head 18H while its neck is immobilized to avoid excessive restraint and to induce the animal to tolerate confinement while observing activities nearby. Nevertheless, it is of critical importance to limit downward movement of the head in order to avoid interference with examination and intravenous fluid injection in the animal's immobilized forelegs 18L, 18L therebelow. Accordingly, the plate 44 is cantilevered forwardly from the front wall 14 in a position to vertically support the head 18H in a normal or natural posture while preventing any access by the mouth to the forelegs and serving as a shield to prevent inadvertent contact by the veterinarian and his aids with the head. Platform 44 is detachably suspended in its cantilevered position by suitable means such as a pair of arms 45, 45 each having a hooked upper end **45*a* integral therewith and releasably engagable with the top marginal edge of the inclined front panel 14*b***.

A door 48 may be provided in one or both side walls 11, 11 to allow administration of intra-muscular injections, especially to fractious animals. One side of the door is hinged as at 49 and its opposite side latched as at 50. The finger opening 51 in the door facilitates manipulation. Suitable vent openings 52 in the upper portions of side walls 11, 11 afford ventilation for compartment 17.

For example, when using the above-described passive restrainer to administer fluids to small animals, the following procedure may be followed:

A. The patient is prepared by placing the appropriate size of catheter (not shown) into the cephalic vein of the forearm and taping or otherwise securing it in place.

B. With compartment 17 opened at its top, the patient is then placed into the compartment and the projecting forelegs 18L, 18L firmly taped or anchored to cantilevered supports 42, 42.

C. The neck-restraining gate plate 33 is then slid into snug fitting position with the neck and locked into place by pin 36.

D. The cantilevered head support and shield 44, 45 is attached.

E. The sliding lid 16 is then slid to closed position.

Once the intravenous drip is started, the patient can be moved to any location desired without risk or fear of the catheter pulling out. The original bottle of fluid, normally associated with the catheter, can be replaced easily as the need arises.

I claim:

1. In a passive restraining apparatus for use in the administration to small animals of anaesthetics, intravenous fluids and the like, comprising (a) a housing (10) for loosely confining therein the main portion of an animal's body including two rear legs in an unstressed condition;

(b) said housing being provided with a front wall (14) having an upper opening (47) therein for holding the animal's neck in substantially immobilized position with its head projecting forwardly from said wall;

(c) said front wall being provided with at least one lower opening (29) for receiving the forearms of the animal's forelegs (18L, 18L) in forwardly projecting positions;

(d) means for immobilizing the outer end portions of said forearms, and (e) means (44) for vertically supporting the animal's head (18H) in spaced relation to and above its immobilized forearms and for relatively free sidewise movement about its neck to thereby prevent access by the head to the forearms and provide a safety zone in which attendants may examine and treat the latter, (f) said last-named means positioned below said upper opening and including a substantially horizontal platform constituting the sole support and restraint of the animal's head while permitting uninterrupted sidewise vision by the animal during the sidewise movement of its head.

2. In a passive restraining apparatus for use in the administration to small animals of anaesthetics, intravenous fluids and the like, comprising (a) an elongated housing (10) having a bottom wall (12), a pair of side walls (11, 11) and a front wall (14) for loosely encompassing the main portion of the body of said animal including two rear legs (18) therein in an unstressed condition;

(b) the upper portion of said front wall being provided with a first opening (47) through which the animal's neck may projects with its head extending forwardly;

(c) the peripheral margin of said opening substantially immobilizing the animal's neck;

(d) the lower portion of said front wall having a pair of laterally spaced openings (29, 29) therein through which the respective forearms may project forwardly;

(e) a pair of laterally spaced elongated members cantilevered forwardly from said front wall for supporting thereon the respective forwardly projecting forearms to thereby provide access by an attendant to the supported forearms from the space between the members;

(f) means individual to each of said cantilevered members for anchoring at least the wrist portion of the associated forearm, and (g) a substantially horizontal platform (44) cantilevered forwardly from said front wall and constituting the sole support and restraint of the animal's head (18H) in spaced relation to and above its projecting forelegs (18L, 18L) and for permitting relatively free lateral movement of the head about the neck, whereby access by the head to the forearms is prevented and a safety zone is provided in which attendants may examine and treat the forearms;

(h) said platform permitting uninterrupted lateral vision by the animal during the lateral movement of its head.

* * * * *